US008201793B1

(12) United States Patent
Powell et al.

(10) Patent No.: US 8,201,793 B1
(45) **Date of Patent: *Jun. 19, 2012**

(54) HABITAT MOUNT FOR WALL MOUNTED TAXIDERMY MANNEQUIN

(75) Inventors: Leon Thomas Powell, Awendaw, SC (US); Roger Aaron Martin, Albemarie, NC (US)

(73) Assignee: McKenzie Sports Products, Inc., Granite Quarry, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/423,407

(22) Filed: Mar. 19, 2012

Related U.S. Application Data

(63) Continuation of application No. 12/565,272, filed on Sep. 23, 2009, now Pat. No. 8,157,234.

(60) Provisional application No. 61/099,719, filed on Sep. 24, 2008.

(51) Int. Cl.
*A47F 5/00* (2006.01)

(52) U.S. Cl. ..... 248/309.1; 248/908; 428/542.4; 428/913.3

(58) Field of Classification Search ..... 248/304, 248/309.1, 126, 221.4, 908; 428/99, 16, 428/542.4, 913.3, 296; D11/131
See application file for complete search history.

(56) References Cited

U.S. PATENT DOCUMENTS

| | | | |
|---|---|---|---|
| 4,717,626 | A | 1/1988 | Badger |
| 4,971,865 | A | 11/1990 | Nowlan |
| 5,472,765 | A | 12/1995 | Green |
| 6,828,035 | B1 | 12/2004 | Goettl |
| 7,207,535 | B1 | 4/2007 | Giuliani |
| 7,655,318 | B2 | 2/2010 | Hall |
| 2002/0063191 | A1 | 5/2002 | Williamson |
| 2006/0154224 | A1 | 7/2006 | St.Ama |
| 2007/0023601 | A1 | 2/2007 | Peek |
| 2009/0230260 | A1 | 9/2009 | Damin |
| 2010/0072339 | A1 | 3/2010 | Powell et al. |
| 2011/0183085 | A1 | 7/2011 | Spiess |

OTHER PUBLICATIONS

U.S. Office Action issued Dec. 2, 2011 in U.S. Appl. No. 12/565,272.

*Primary Examiner* — Ramon Ramirez
(74) *Attorney, Agent, or Firm* — Panitch Schwarze Belisario & Nadel LLP

(57) ABSTRACT

A habitat mount for a wall mounted taxidermy mannequin includes a habitat piece having a three dimensional first side with the appearance of one or more natural elements and an opposing generally planar second side. A tab extends outwardly from and generally parallel to a plane defined by the second side of the habitat piece. The tab is sized and shaped to mount directly to a rear side of the wall mounted taxidermy mannequin.

6 Claims, 2 Drawing Sheets

HABITAT MOUNT FOR WALL MOUNTED TAXIDERMY MANNEQUIN

CROSS-REFERENCE TO RELATED APPLICATION

The present application is a continuation of U.S. patent application Ser. No. 12/565,272, filed Sep. 23, 2009, now U.S. Pat. No. 8,157,234, issued Apr. 17, 2012 and entitled "Habitat Mount for Wall Mounted Taxidermy Mannequin," which claims the benefit of U.S. Provisional Patent Application No. 61/099,719, filed Sep. 24, 2008 and entitled "Habitat Mount for Wall Mounted Taxidermy Mannequin."

BACKGROUND OF THE INVENTION

The present invention relates to a habitat mount for a wall mounted taxidermy mannequin and, more specifically, to a habitat mount that allows for one or more pieces of a real or faux natural habitat to be attached to a wall mounted taxidermy mannequin.

In the field of taxidermy, mannequins (also referred to as mannequin forms or animal forms) are used to mount animal heads or other parts of an animal carcass to a wall. Animals that are mounted on a ground base, such as full body life size animals typically include one or more pieces of artificial or real habitat elements, such as rocks, wood or grasses, to create a natural looking setting of what the animal looks like in the wild and to give a more aesthetic or life-like appearance. However, wall mounted mannequins typically have a low profile base leaving little or no room to add on habitat elements. A conventional mannequin may be similar in appearance to the mannequin shown in FIG. 1.

It would be desirable to provide a habitat piece or pieces that mount to a wall hanging taxidermy mannequin to create a realistic display.

BRIEF SUMMARY OF THE INVENTION

Briefly stated, a preferred embodiment of the present invention is directed to a habitat mount for a wall mounted taxidermy mannequin. The habitat mount includes a habitat piece including a three dimensional first side having the appearance of one or more natural elements and an opposing generally planar second side. A tab extends outwardly from and generally parallel to a plane defined by the second side of the habitat piece. The tab is sized and shaped to mount directly to a rear side of the wall mounted taxidermy mannequin.

In another aspect, a preferred embodiment of the present invention is directed to a combined wall mounted taxidermy mannequin and habitat mount that includes an animal bust having a three dimensional first side and an opposing generally planar rear side. A habitat piece includes a three dimensional first side having the appearance of one or more natural elements and an opposing generally planar second side. A tab extends outwardly from and generally parallel to the second side of the habitat piece. The tab is sized and shaped to mount to the rear side of the animal bust. The habitat piece is positioned substantially beneath the animal bust when the combined habitat piece and wall mounted taxidermy mannequin are mounted to a wall.

BRIEF DESCRIPTION OF THE SEVERAL VIEWS OF THE DRAWINGS

The following detailed description of preferred embodiments of the present invention will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
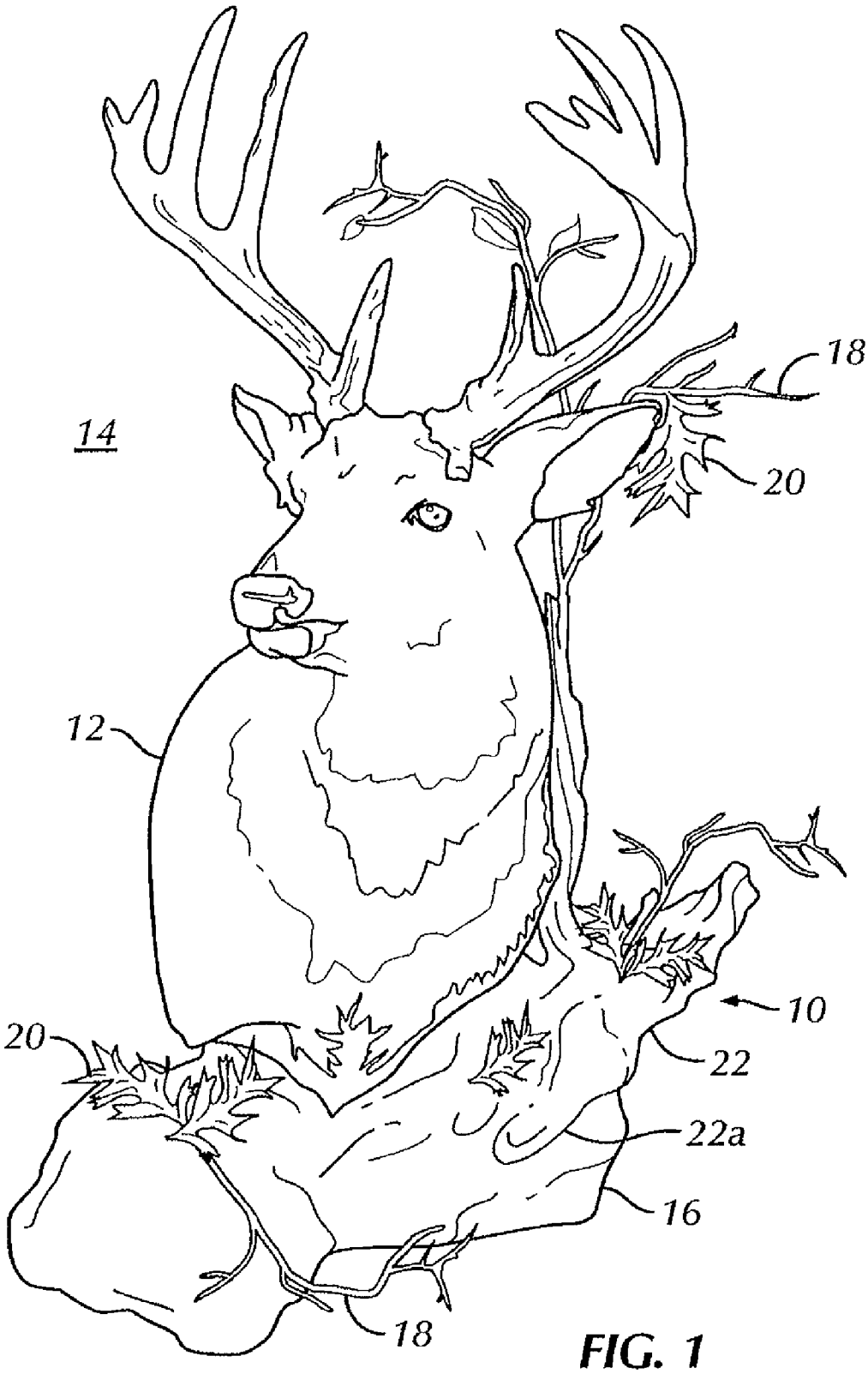
FIG. 1 is a front perspective view of a habitat mount in accordance with a first preferred embodiment of the present invention mounted to a wall mounted taxidermy mannequin.

Certain terminology is used in the following description for convenience only and is not limiting. The words "right", "left", "lower" and "upper" designate directions in the drawings to which reference is made. The words "inwardly" and "outwardly" refer to directions toward and away from, respectively, the geometric center of the habitat mount and designated parts thereof. Unless specifically set forth herein, the terms "a", "an" and "the" are not limited to one element but instead should be read as meaning "at least one." The terminology includes the words noted above, derivatives thereof and words of similar import.

Figure 2:
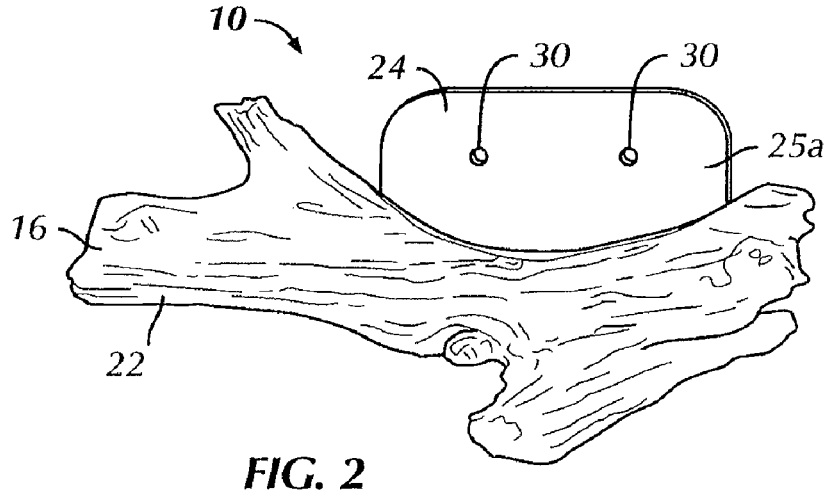
FIG. 2 is a front perspective view of the habitat mount shown in FIG. 1 with the wall mounted taxidermy mannequin removed.
Figure 3:
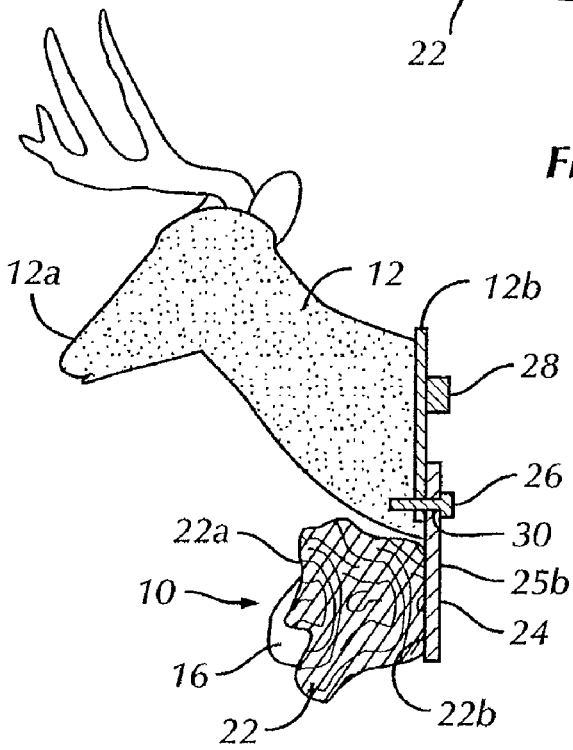
FIG. 3 is side cross sectional view of the habitat mount and wall mounted taxidermy mannequin shown in FIG. 1.

Referring to the drawings in detail, wherein like reference numerals indicate like elements throughout, there is shown in FIGS. 1-3 a habitat mount or assembly, generally designated 10, in accordance with a first preferred embodiment of the present invention. The habitat mount 10 is for use with a conventional wall mounted taxidermy mannequin 12, which is preferably a bust of an animal (FIG. 1). The mannequin 12 is shown to be a head, neck and shoulders of a buck, but the mannequin 12 may be any animal, real or faux, in whole or in part that is hung or otherwise mounted on a generally vertical wall 14. As seen in FIGS. 1 and 3, the mannequin 12 includes a generally three dimensional (3D) first side 12*a*.

Referring to FIGS. 1-3, the habitat mount 10 includes at least one three dimensional habitat piece or scene 22 generally having a length, width and height, and a three dimensional (3D) front surface or side 22*a*. The term "three dimensional" is defined herein as a surface that is not flat or planar, but generally contoured and/or rough, such as the exterior surface of a stone, in addition to the three dimensions (i.e., length, width and height) of the habitat mount 10 or mannequin 12. The front surface 22*a* preferably resembles and/or mimics a natural or outdoor setting where the mounted mannequin 12 is typically observed in the wild. Although it is preferred that the front surface 22*a* is three dimensional, the habitat piece may include a planar scene of a natural element or environment, such as a photograph. The front surface 22*a* generally opposes a generally flat rear surface or side 22*b* (FIG. 3). However, the rear side 22*b* may also be three dimensional (3D).

In the present embodiment, the habitat piece 22 preferably resembles a piece of dead wood 16 and includes twigs or tree branches 18 and leaves 20, but may include or replicate any natural element, such as stones, rocks, grass and/or a stream of water. The habitat piece 22 is preferably molded of a lightweight material, such as expanding polyurethane foam. However, the wood 16, twigs 18 and/or leaves 20 may be real or faux. For example, the wood 16 may be molded out of a foam material and painted to look realistic, while real or natural twigs 18 and leaves 20 are affixed to the wood 16, such that the habitat piece 22 is a combination of both real and artificial/synthetic natural elements.

The habitat mount 10 further includes a tab 24 for mounting the habitat mount 10 to a generally planar rear side or back 12*b* of the mannequin 12. The rear side 12*b* of the mannequin 12 generally opposes the front side 12*a* of the mannequin 12. The preferably generally planar tab 24 is mounted to the back 22*b* of the habitat piece 22 and defines a plane that is generally parallel to the wall 14 when the habitat mount 10 is hung/mounted thereto. A top of the tab 24 may extend above a top of the back 12*b* of the mannequin 12 in the hung/mounted position or the top of the tab 24 may be between a top and bottom of the back 12*b* of the mannequin 12 (see FIG. 3) in the hung/mounted position. The tab 24 is preferably a wooden panel or board that is secured to or co-molded with the habitat piece 22. However, the tab 24 may be comprised of any material, such as foam or metal and attached to the habitat piece 22 in any suitable manner, such as using an adhesive, being only attached to a portion of the habitat piece 22, attached within a slot (not shown) in the habitat piece 22 or integrally formed from the same material as the habitat piece 22.

The tab 24 preferably extends outwardly from the habitat piece 22 and is preferably generally parallel with the rear 22*b* of the habitat piece 22 such that the habitat mount 10 lies generally flat against the wall 14 during use. In the preferred embodiment, the tab 24 includes a generally planar first surface or side 25*a* that opposes a generally planar second surface or side 25*b*. The second or rear surface 25*b* is generally parallel to the wall 14 and in facing engagement therewith when the habitat mount 10 is mounted to the wall 14. The tab 24 is also preferably sufficiently thin to prevent the tab 24 from interfering with a hanger 28 used to mount the mannequin 22 to the wall 14, such that the habitat mount 10 may be used with conventional and pre-existing mannequins 12.

In the preferred embodiment, the habitat piece 22 is preferably sized and shaped to mount directly to the rear side 12*b* of the mannequin 12. In one embodiment, a portion of the back 12*a* of the mannequin 12 may be recessed to receive the tab 24, such that the rear surface 25*a* of the tab 24 is generally flush and generally parallel with the remainder of the back 12*a*. Further, the habitat piece 22 is sized and shaped to at least partially match the contour of the mannequin 12, at least proximate the tab 24, to conceal the entire tab 24 behind the mannequin 12 and keep the habitat piece 22 close to the mannequin 12. In the preferred embodiment, the front surface 25*a* of the tab 24 is generally in facing engagement with the rear side 12*b* of the mannequin 12 when the habitat mount 10 and mannequin 12 are mounted to the wall 14.

The tab 24 is preferable mounted to the mannequin 12 using at least one but preferable two spaced-apart fasteners 26, such as screws (one shown in FIG. 3), bolts, nails, snaps or adhesive. Two fasteners 26 are preferred to prevent the habitat mount 10 from twisting and/or turning with respect to the mannequin 12. However, any number of fasteners 26 may be used to attached the habitat mount 10 to the mannequin 12. The habitat mount 10 may be either releasably or permanently affixed to the mannequin 12. The tab 24 may include holes 30 formed during the manufacturing process. The holes 30 may or may not be sized and shaped to receive the fasteners 26. However, the tab 24 need not include pre-fabricated holes 30 and may allow the user to place one or more fasteners 26 wherever they desire or the tab 24 may include indicator markings (not shown) to suggest where to place the fasteners 26 when mounting the habitat mount 10 to the rear 12*a* of the mannequin 12. The two fasteners 26 preferably extend through the front and rear surface 25*a*, 25*b* of the tab 24 and into at least a portion of the mannequin 12 when the habitat piece 10 and mannequin 12 are mounted to the wall 14.

In an assembled configuration (FIGS. 1 and 3), the entire habitat piece 22 is positioned beneath at least a portion of the mannequin 12 when the habitat mount 10 and mannequin 12 are mounted to the wall 14. Further, in the assembled configuration (FIGS. 1 and 3), at least a portion of the habitat piece 22 extends below a lowest-most portion of the tab 24 when the habitat mount 10 and mannequin 12 are mounted to the wall 14. The habitat piece 22 may be placed at any location around the mannequin 12, such as above or to a side of the mannequin 12, but the habitat piece 22 is preferably positioned substantially beneath the mannequin 12 when the combined habitat mount 10 and mannequin 12 are mounted to the wall 14.

Figure 4:
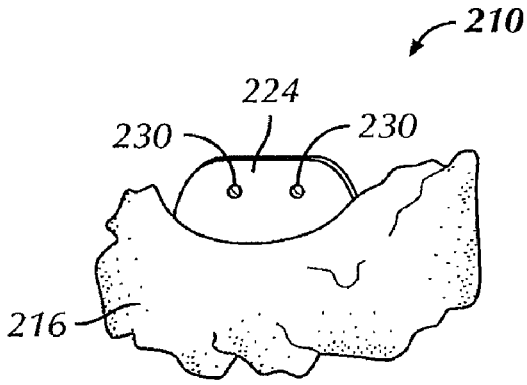
FIG. 4 is a front perspective view of a habitat mount in accordance with a second preferred embodiment of the present invention with the wall mounted taxidermy mannequin removed.

Referring to FIG. 4, there is shown a second preferred embodiment of the habitat mount, generally designated 210. The habitat mount 210 of the second embodiment is substantially similar to the first preferred embodiment of the habitat mount 10, except that the habitat mount 210 is or resembles a rock 216.

Figure 5:
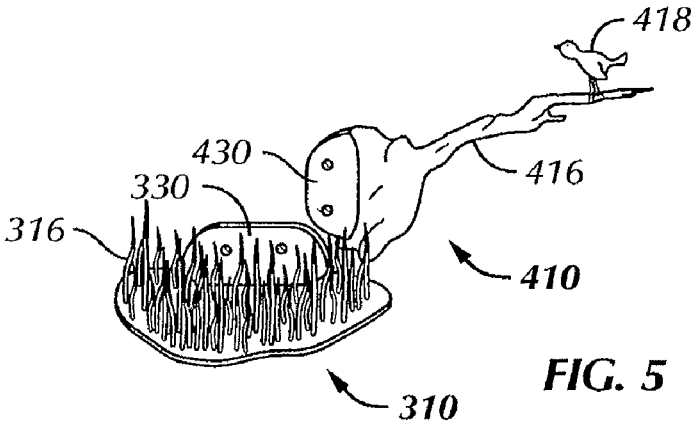
FIG. 5 is a front perspective view of two habitat mounts in accordance with third and fourth preferred embodiments of the present invention with the wall mounted taxidermy mannequin removed.

Referring to FIG. 5, there is shown third and fourth preferred embodiments of the habitat mount, generally designated 310 and 410, respectively. The habitat mounts 310 and 410 of the third and fourth embodiments are substantially similar to the first preferred embodiment of the habitat mount 10, except that the habitat mount 310 is or resembles a collection of grass 316 and the habitat mount 410 is or resembles a tree branch 416 with a bird 418. Thus, one or more habitat mounts 310, 410 may be placed around the contour of the mannequin 12 and surround a portion or the entire outer contour of the mannequin 12. Specifically, a second habitat piece may be placed adjacent to the first habitat piece, such that the two are positioned adjacent to one another on the wall 14.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A combined wall mounted taxidermy mannequin and habitat mount comprising:

an animal bust having a three dimensional first side and an opposing generally planar rear side;

a habitat piece including a three dimensional first side having the appearance of one or more natural elements and an opposing generally planar second side; and a tab extending outwardly from and generally parallel to the second side of the habitat piece, the tab being sized and shaped to mount to the rear side of the animal bust, wherein the habitat piece is positioned adjacent the animal bust when the combined habitat mount and wall mounted taxidermy mannequin are mounted to a wall.

2. The combined wall mounted taxidermy mannequin and habitat mount according to claim 1, wherein the tab is generally planar and includes a front surface and an opposing rear surface, the rear surface being generally parallel to the wall when the wall mounted taxidermy mannequin and habitat mount are mounted to the wall.

3. The combined wall mounted taxidermy mannequin and habitat mount according to claim 2, wherein the entire front surface of the tab is generally covered by and in facing engagement with the rear side of the animal bust when the wall mounted taxidermy mannequin and habitat mount are mounted to the wall.

4. The habitat mount according to claim 2, wherein at least two spaced-apart fasteners extend through the front and rear surfaces of the tab and into at least a portion of the animal bust when the wall mounted taxidermy mannequin and habitat mount are mounted to the wall.

5. The combined wall mounted taxidermy mannequin and habitat mount according to claim 1, further comprising:

a second habitat mount including a second habitat piece having a three dimensional first side having the appearance of one or more natural elements and an opposing generally planar second side, wherein the two habitat mounts are positioned adjacent to one another on the wall.

6. The combined wall mounted taxidermy mannequin and habitat mount according to claim 1, wherein the natural element is selected from the group consisting of a rock, a piece of wood, a leaf and grass.

* * * * *